US005673515A

United States Patent [19]

Weber et al.

[11] Patent Number: 5,673,515

[45] Date of Patent: Oct. 7, 1997

[54] TWO-STRAND CABLE WINDOW REGULATOR FOR OPERATION OF A SPHERICALLY CURVED WINDOW

[75] Inventors: Horst Weber, Wirsberg; Gerhard Hofmann, Untersiemau, both of Germany

[73] Assignee: Brose Fahrzeugteile GmbH & Co. KG, Coburg, Germany

[21] Appl. No.: 516,348

[22] Filed: Aug. 8, 1995

[30] Foreign Application Priority Data

Aug. 8, 1994 [DE] Germany ..... 44 27 989.2

[51] Int. Cl.[6] ..... E05F 11/48

[52] U.S. Cl. ..... 49/352; 49/140; 49/374

[58] Field of Search ..... 49/139, 140, 226, 49/227, 348, 352, 374, 349, 375

[56] References Cited

U.S. PATENT DOCUMENTS

| | | | |
|---|---|---|---|
| 2,803,492 | 8/1957 | Wright | 49/227 |
| 2,873,612 | 2/1959 | Schneidewind | 49/227 |
| 2,947,569 | 8/1960 | McDougall | 49/227 |
| 2,998,246 | 8/1961 | Probst | 49/227 |
| 4,001,971 | 1/1977 | Gobush et al. | 49/352 |
| 4,658,546 | 4/1987 | Moriyama | 49/227 |
| 4,693,127 | 9/1987 | Alty | 74/25 |
| 4,819,380 | 4/1989 | Trebbi | 49/374 |
| 4,910,917 | 3/1990 | Brauer | 49/452 |
| 4,974,363 | 12/1990 | Reaney | 49/374 |
| 4,974,365 | 12/1990 | Ono | 49/348 |
| 5,469,663 | 11/1995 | TenBrink et al. | 49/352 |

FOREIGN PATENT DOCUMENTS

| | | |
|---|---|---|
| 3615578 | 9/1987 | Germany . |
| 3925864 | 8/1990 | Germany . |

*Primary Examiner*—Kenneth J. Dorner
*Assistant Examiner*—Curtis Cohen
*Attorney, Agent, or Firm*—Christie, Parker & Hale, LLP

[57] ABSTRACT

The invention concerns a two-strand cable window regulator for motor vehicles having two guide rails which is specifically designed to control spherically curved windows. The invention ensures exact conformity with a predefined raising/lowering path with extremely different radii of curvature of the window at the locations of the two guide rails.

The present invention ensures exact conformity by modifying the travel distance of the window near at least one guide rail such that the travel distance of the window is either larger or smaller than the distance traveled by the respective carrier connected to the guide rail.

14 Claims, 4 Drawing Sheets

7
500
520
60A
60B
10A'''
10B'''
70
M
M
6A
6B
5A
5B
1A'''
1B'''
510
530

TWO-STRAND CABLE WINDOW REGULATOR FOR OPERATION OF A SPHERICALLY CURVED WINDOW

FIELD OF THE INVENTION

The present invention relates to a two-strand cable window regulator. In particular, the window regulator is specifically designed for control of spherically curved windows of motor vehicle door panels and ensures exact conformity with a predefined lowering/raising path with extremely different radii of curvature of the window located at the two guide rails of the door panel.

BACKGROUND OF THE INVENTION

It is customary to operate spherically curved windows in motor vehicles with hand window regulators, whereby the windows slide in side rails within the vehicle door which reach almost to the bottom of the door. These side rails are necessary to be able to eliminate the forces developing perpendicular to the plane of the window. However, the side rail in the lock region of the door often causes space problems, in particular when the door design is particularly narrow. Consequently, a part of the side rail is often manufactured as an additional and separate part and is installed after assembly of the lock, which increases assembly expense.

In addition, the use of one-strand cable window regulators known in the art often is impractical for the raising and lowering of large, spherically shaped windows, since tipping of the window caused by an inadequate supporting base very often cannot be avoided.

Conventional two-strand cable window regulators are suited to reliably guiding the window in the so-called Y-direction (i.e., at right angle to the plane of the window) and to avoid tipping of the window, but the typical parallel lowering does not correspond to the requirements of the different lowering distances at the locations of each of the two respective guide rails caused by the spherical curvature of the window. Consequently, the window inevitably tips out of its planned tracking path, which may additionally result in jamming.

German patent publication DE-C1 36 15 578 discloses a cable window regulator which presents a combination of two one-strand window regulators whereby each of the two endless loops of cable is guided by a separate cable drum. A single, common drive gear transfers the driving power to both cable drums. The purpose of the design is to avoid alternating bending of each cable and, thus, to improve life of the cable.

Therefore, there is a need to develop a two-strand cable window regulator for motor vehicles which ensures exact lowering of a spherically curved window on a planned lowering path with the use of a simple and economical design. The window regulator should have a low space requirement and ensure good accessibility in the lock region.

SUMMARY OF INVENTION

The present invention is a two-strand window regulator for spherically curved windows, having two guide rails with respective carriers, of which at least one guide rail defines a carrier travel distance which is not equal to a corresponding window travel distance along the window's raising/lowering path. In the case that the guide rail is in the region of the smaller radius of curvature of the spherically curved window, it results in a shortening of the window travel distance. Alternatively, if the guide rail is in the region of the larger radius of curvature of the window, it results in a lengthening of the window travel distance.

The present invention controls the raising/lowering of spherically curved windows and ensures conformity with a predefined path with extremely different radii of curvature of the window located at the two guide rails. This may be accomplished by the following three secondary principles.

First, the guide rail in the region of the smaller radius of the spherical curvature of the window (usually near the A-pillar, or the front hinge pillar region of the door) is disposed at a slant compared to the other guide rail at the location of the larger radius of the window curvature in the displacement plane of the window. The slant is selected such that a carrier during its travel along the guide rail, between its upper and its lower stop position, causes a desired, reduced travel distance of the window along its raising/lowering path.

In order to compensate for the different distances between the carrier and the window bracket at different window positions, some method of compensation acting at a right angle to the lowering path between the carrier and the window bracket (window mounting) is necessary. For example, the compensation can be provided by a compensating rail which is movably connected to the carrier and to the window bracket. The sliding joint of this compensating rail can be disposed either on the carrier or on the window bracket. In addition, it is also possible to provide the compensating movement by means of an elongated slot in the window and a sliding element of the carrier which engages therein.

In a second embodiment, the guide rail in the region of the smaller radius of curvature of the spherical window is curved in the lowering plane at right angles to the lowering path such that a compensating arm linked to the carrier pointing into the interior of the radius of curvature effects the desired curvature of the travel in comparison to the other guide rail. In this case, the compensating arm is connected with the window bracket by means of a rotatable sliding joint. To change the relationship between the displacement distance of the carrier and of the guide rail and the actual travel accomplished, the degree of curvature of the guide rail and/or the lever length of the compensating arm may be appropriately adapted.

Finally, the two guide rails can be disposed on opposite sides of the window, as opposed to prior devices wherein the guide rails were disposed on the same sides of the window. That is, one guide rail is in the region of the smaller radius of curvature of the spherical window in the external space between the window and the exterior panel of the door, and the second guide rail is in the internal space between the window and the interior trim panel of the door. In this embodiment, the radius of the outer guide rail adapted to the window curvature is larger than the radius of curvature of the window, and the radius of the inner guide rail is smaller than the radius of curvature of the window at its corresponding location. An adaptation of the travel distance of the two guide rails to the given requirements of an application may occur by means of modification of the distance of the window glass from the guide path of the guide rail by the use of a lever. Thus, appropriate lever length increases to reduce the travel of the window along the outer guide rail, while increasing the lever length on the inner guide rail results in increasing the travel distance of the window.

Each embodiment disclosed has the distinct advantage that the parallel window raising/lowering characteristic of two-strand cable window regulators can be adapted with simple means to the specific needs of a spherically curved window. Despite equally long displacement paths of the carrier on the two guide rails, the window is moved with different travel distances in the region of the two guide rails.

A final embodiment of the present invention which can be used for displacement of a spherically curved window along two guide rails consists in the use of two separate cables stretched along two distinct guide rails to which respective separate electric motor drives are allocated. The electric motor drives are controlled by a common electronic control unit, which allows the window to be driven in different desired travel distance relationships, in particular through the use of position detection by the control unit.

Importantly, assembly space is gained by elimination of the crossed cable loops. In addition, adaptation to the different window and door panel characteristics of various vehicles is handled largely by software in the electronic control unit.

BRIEF DESCRIPTION OF THE DRAWINGS

The invention is explained in detail referring to exemplary embodiments and the figures presented where.

DETAILED DESCRIPTION

The present invention is used in applications in which the advantages of a two-strand cable window regulator coupled with a nonparallel raising/lowering of a window are necessary. An example of such an application is a window which has a pronounced but nonuniform spherical curvature. With the use of a two-strand cable window regulator whose guide rails are disposed in regions of different radius of window curvature, it is necessary to drive the window in the location of the two guide rails with respective different travel distances. In particular, the large front windows between the hinge pillar (i.e. A-pillar) and the center pillar (i.e. B-pillar) of a motor vehicle often present such requirements. However, in principle, the rear windows guided between the center pillar and the lock pillar can also be moved with the window regulators described herein.

The present invention provides various embodiments which achieve the object of the invention. As to which of the following technical means for shortening the travel distance along one guide rail compared to the other guide rail should be used in each application, depends on the concrete conditions of the individual case.

Figure 1:
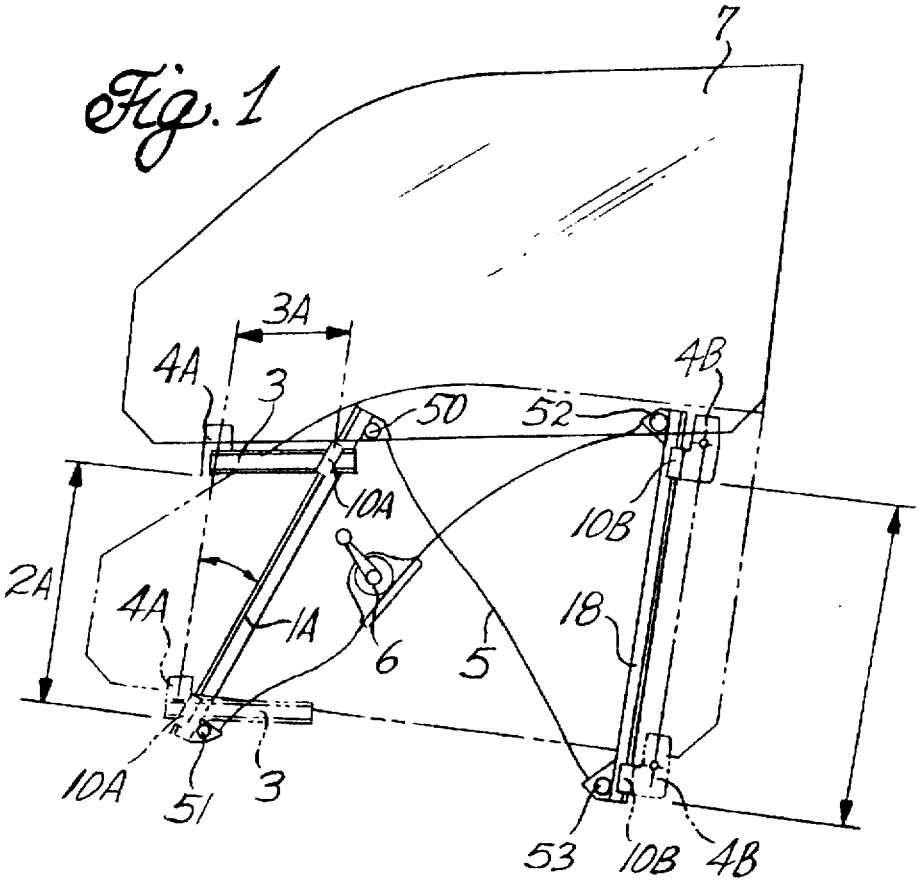
FIG. 1 is a schematic representation of a two-strand cable window regulator with the guide rail on the hinge pillar side disposed at a slant.

FIG. 1 schematically depicts a two-strand cable window regulator whose guide rail 1A on the hinge pillar side (guide rail in the region of the smaller radius of curvature of the window) is disposed at an angle $\alpha$ relative to the other guide rail 1B on the center pillar side. For clarification of the structural design, both the angle of slant $\alpha$ and the length 3A of a compensating rail 3 dependent thereon is depicted greatly exaggerated.

Moreover, FIG. 1 depicts the carriers 10A, 10B, which are respectively connected to the window by window brackets 4A, 4B, guided on the guide rails 1A, 1B in their corresponding top and bottom stop positions. The compensating rail 3, in the form of a longitudinally grooved box section which is shiftably guided on a fitting shaped part of the carrier 10A in the X-direction and which is at right angles to the raising/lowering path of window 7, is also shown in its top and bottom stop positions. In FIG. 1, the top stop position (i.e., when the window is closed) of each carrier 10A, 10B, each window bracket 4A, 4B, and the compensating rail 3 is represented with solid lines, and the bottom stop position (i.e., when window is open) of each carrier 10A, 10B, each window bracket 4A, 4B, and the compensating rail 3 is depicted as a phantom representation having broken lines with reference numerals corresponding to the top stop position. These solid and broken line representations are utilized in each of the figures to respectively distinguish between the corresponding top and bottom stop positions of each element having a top and bottom stop position.

Figure 1A:
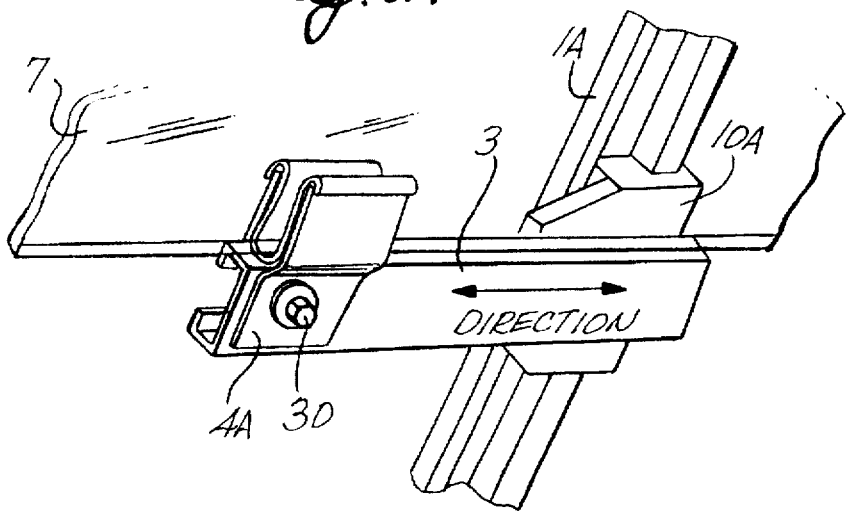
FIG. 1*a* is a detail of FIG. 1 displaying a compensation rail attached to a window bracket guided on a carrier.

Referring to FIG. 1*a*, the window bracket 4A is executed as a clamping element, between whose jaws the window 7 is clamped. Screw connection 30 serves to generate the clamping force to fasten the window to the compensating rail 3. As seen in FIG. 1, the other carrier 10B is directly connected with the window bracket 4B.

Both guide rails 1A, 1B are the same length and have on their respective ends guide pulleys 50, 51, 52, 53 by means of which an endless cable loop 5 is guided. The carriers 10A, 10B are in fixed connection with the cable loop 5 in order to be able to absorb the regulating force generated by a window crank or other type of drive 6.

Upon operation of the drive, the carriers 10A, 10B are shifted on the guide rails 1A, 1B by the same distance. However, because of the slant of the guide rail 1A by the angle $\alpha$, the maximum travel distance of the window in this region of guide rail 1A is shortened and is represented as follows:

$$\text{travel distance } 2A = \text{travel distance } 2B \times \cos\alpha$$

whereby the travel distance 2B of the window in the region of the guide rail 1B running parallel to the raising/lowering path of the window 7 corresponds exactly to the displacement distance of the carrier 10A on the slanted guide rail 1A.

During the raising or the lowering of the window 7, the distance between the window bracket 4A and the carrier 10A changes continuously. The necessary compensation occurs by means of a sliding joint connection between the carrier 10A and the compensating rail 3. Of course, differently designed sliding joint connections can be used. For example, the window bracket 4A is mounted shiftably on the compensating rail 3 or a sliding joint connection or is designed which includes an elongated slot provided in the window 7.

In a typical embodiment, the compensating rail 3 is at least the length of a short side of a parallelogram which is formed by a pair of parallel sides formed by the top and bottom positions of the carrier 10A running parallel to the raising/lowering path and by a second pair of parallel sides formed by carrier 10A at its top and bottom positions perpendicular, at a right angle, to the raising/lowering path.

Figure 2:
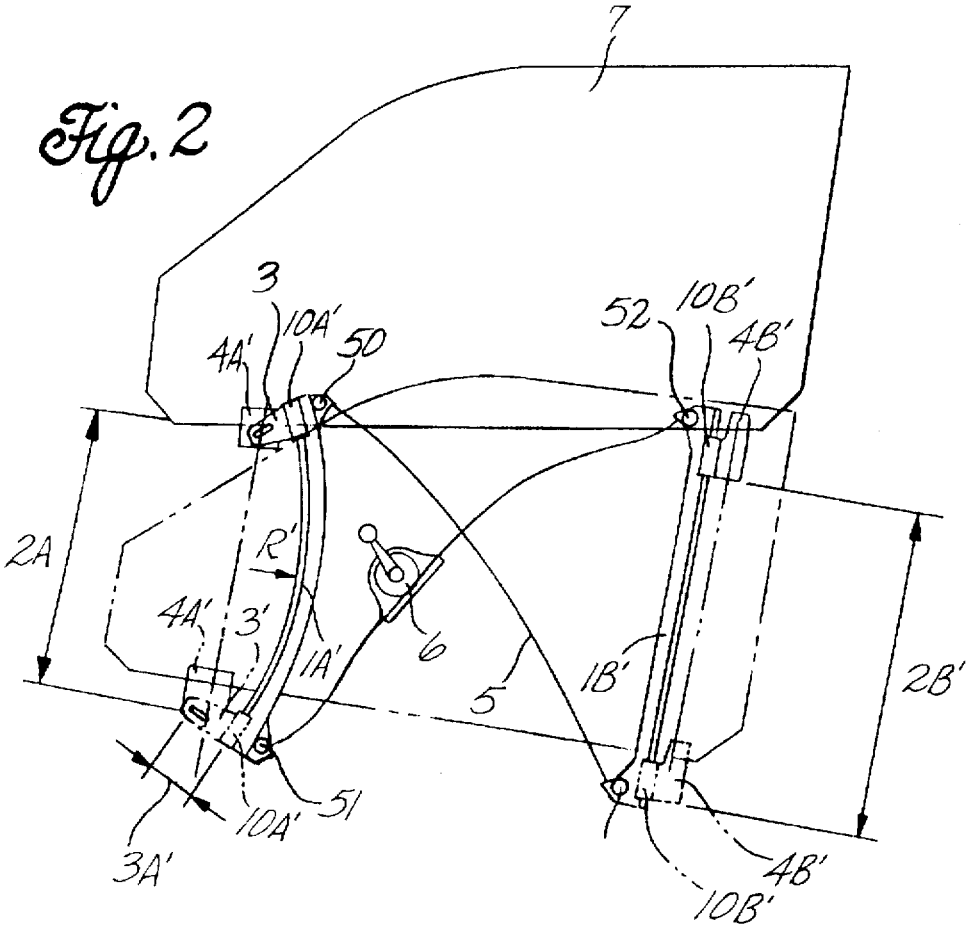
FIG. 2 is a schematic representation of a two-strand cable window regulator with a curved guide rail on the hinge pillar side.

FIG. 2 schematically depicts an additional embodiment of the invention of a two-strand cable window regulator using endless cable loop 5, which is guided by means of cable pulleys 50, 51, 52, 53 and is connected with carriers 10A' and 10B'. Whereas carrier 10B' rests movably on the straight guide rail 1B' running parallel to the raising/lowering direction and bears a window bracket 4B' for mounting on the bottom edge of the window 7, the other carrier 10A' is disposed on a guide rail 1A' curved in the raising/lowering plane. Guide rail 1A' is located in the region of the smaller radius of curvature of the window and effects a shortening of the travel distance of the window compared to the other guide rail 1B', which is of the same length as guide rail 1A'.

Figure 2A:
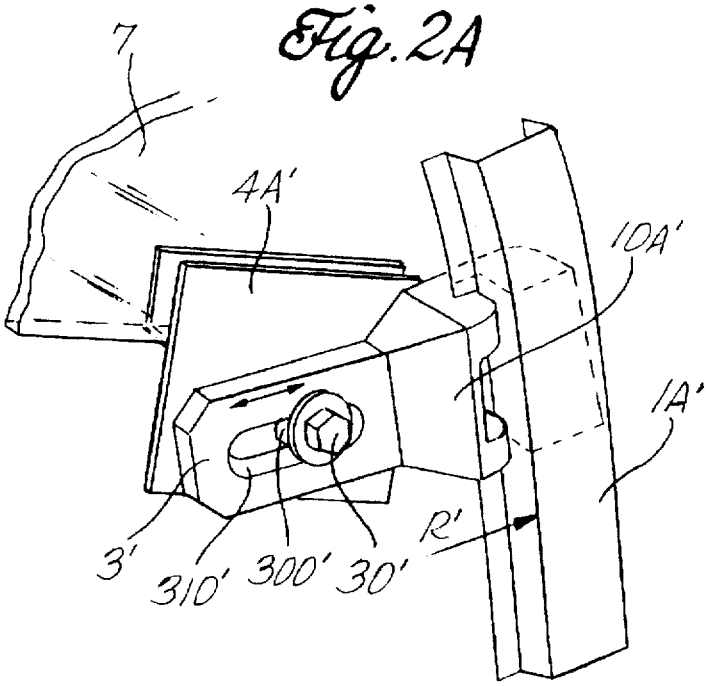
FIG. 2*a* is a detail of FIG. 2 displaying a carrier with compensating arm attached to a window bracket.

FIG. 2*a* depicts a detail of FIG. 2. According to FIG. 2*a*, a compensating arm 3' is connected at a right angle to the carrier 10A' and has an elongated slot 310' running in the same direction. Through the elongated slot 310', a screw connection 30' passes to mount the compensation arm on the window 7 bracket 4A'. With the cylindrical shaft 300' of the screw connection 30', the elongated slot 310' forms a rotatable sliding joint to compensate for the different angular positions of the carrier 10A' and for the distance between the carrier 10A' and the window bracket 4A', which varies during window operation.

If the window 7 travels between its top and bottom stop positions, the two carriers 10A', 10B' both cover an equally long path; however, the travel distance 2A' of the window is reduced compared to the travel distance 2B' of the straight guide rail 1B'. The shortening of the travel distance is greater the smaller the radius of curvature R' of the guide rail 1A' (i.e., the sharper the curve of guide rail 1A').

The compensating arm 3' pointing in the direction of the center of the radius of curvature of the guide rail 1A' guides the window bracket 4A' apparently in an arc whose radius is smaller than the radius R' of the guide rail 1A'. Thus, it is possible to affect the amount of shortening of the travel distance of the window through variation of the distance of the window bracket 4A' from the guide rail 1A'.

On the other hand, it is also possible to use a straight shaped guide rail on the hinge pillar side and to equip a curved guide rail on the center pillar side with a carrier such that its compensating arm points radially outward, i.e., away from the center of the circle of curvature. Thus, a travel distance increase is caused on this guide rail. The travel distance on the guide rail on the hinge pillar side in the region of the smaller radius of curvature of the window 7 thus remains relatively smaller. Advantages of the invention can be accomplished equally well with both embodiments.

Figures 3, 3A, 3B, 3C:
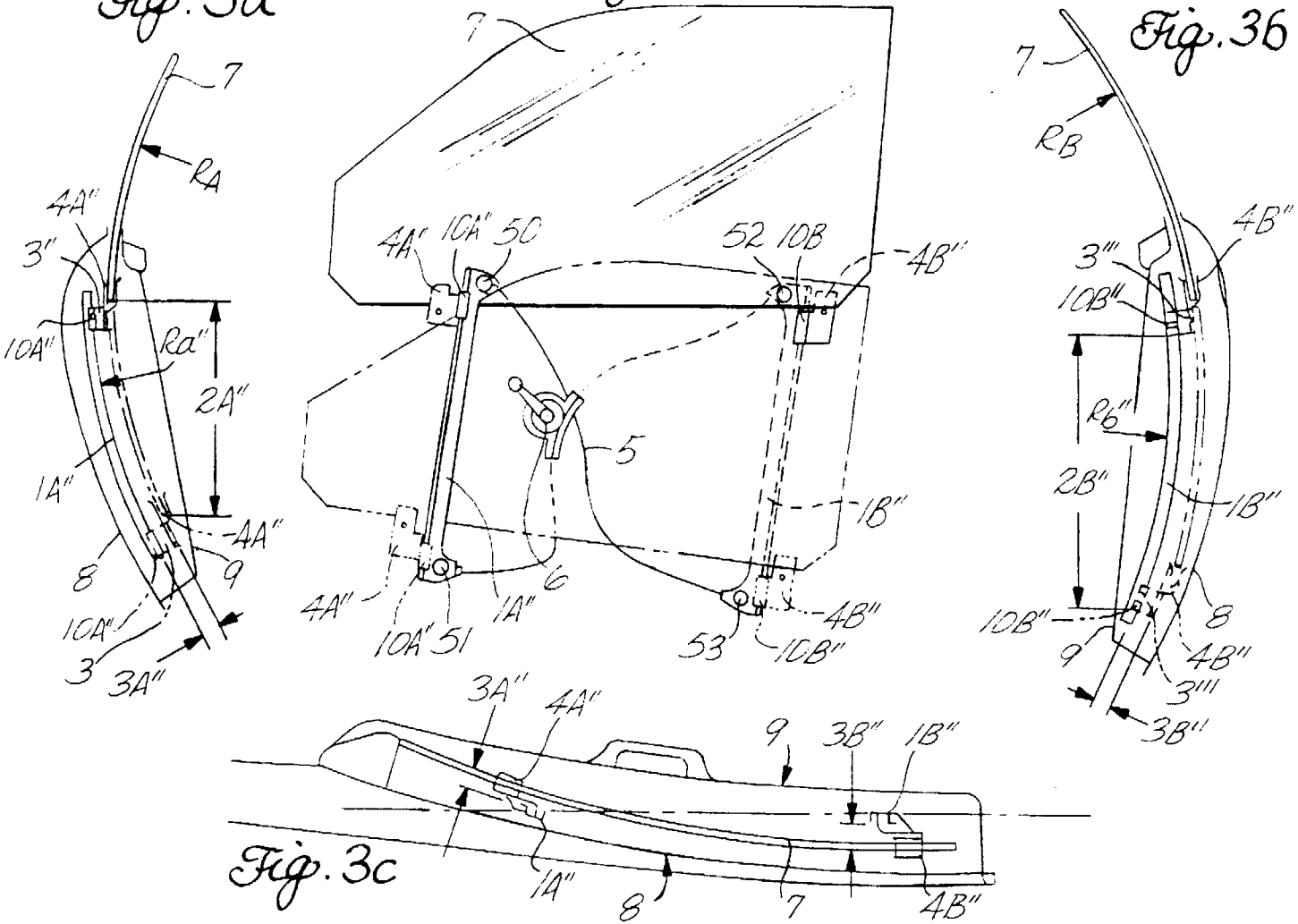
FIG. 3 is a schematic representation of a two-strand cable window regulator with an external guide rail on the hinge pillar side and an internal guide rail on the center pillar side.
FIG. 3*a* is a schematic representation of FIG. 3 of a longitudinal section through the vehicle door of FIG. 3 along line 3*a*—3*a* in the region of the guide rail on the hinge pillar side.
FIG. 3*b* is a schematic representation FIG. 3 of a longitudinal section through the vehicle door along line 3*b*—3*b* in the region of the guide rail on the center pillar side.
FIG. 3*c* is a schematic representation of FIG. 3 of a cross-section of the vehicle door along line 3*c*—3*c*.

FIG. 3 through 3*c* depict a further embodiment of the invention. Here again, there is a two-strand cable window regulator consisting of the customary components including guide rails 1A", 1B", carriers 10A", 10B" with window brackets 4A", 4B", guide pulleys 50, 51, 52, 53 to guide the cable loop 5 and drive 6. Spherically curved window 7 has as depicted in FIG. 3*a* region of smaller radium of curvature $R_A$, as depicted in FIG. 3*b* region of larger radius of curvature $R_B$, and as depicted in FIG. 3*c* transitional radii of curvature therebetween. However, a novel and unobvious feature consists in that the guide rail 1A" on the hinge pillar side is disposed in the region of the smaller radius of curvature $R_A$ of the spherical window 7 between the exterior panel 8 of the door and the window 7, whereas the other guide rail 1B" on the center pillar side is mounted in the region of the larger radius of curvature $R_B$ of window 7 between the interior panel 9 of the door and the window 7. Here, the radius of curvature R" of the outer guide rail 1A" on the hinge pillar side is greater than the radius of curvature $R_A$ of the window 7; on the contrary, the radius of curvature $R_b$" of the inner guide rail 1B" on the center pillar side is greater than the radius of curvature $R_B$ of the window 7 in this region.

Between the carriers 10A", 10B" and the window brackets 4A", 4B" there is a distance defined by respective lengths 3A", 3B" of connection levers 3", 3"'. With increasing lever lengths 3A", 3B", travel distances 2A", 2B" deviating more greatly from the displacement distances of the carriers 10A", 10B" are generated. Thus, increases in the length of the inward pointing connection lever 3" result in a travel distance shortening on the outer guide rail 1A" on the hinge pillar side; in contrast, increases in the length of the outward pointing connection lever 3"' cause a travel distance increase on the inner guide rail 1B" on the center pillar side. By harmonizing the structural conditions of the window attachment of the two guide rails 1A", 1B", the respective travel distances 2A", 2B" are defined.

At this point, it should also be indicated that the embodiment of the invention just described requires a Bowden window regulator such that the cable 5 can be guided below the bottom edge of the window, even when the window 7 is in its lowest position. Bowden window regulators, which are well known in the art, use a cable surrounded by a sheath or casing wherein the end points of the sheath or casing are in space. In this way, the cable can be moved within the sheath or casing when the window crank or other type of drive 6 is activated.

Figure 4:
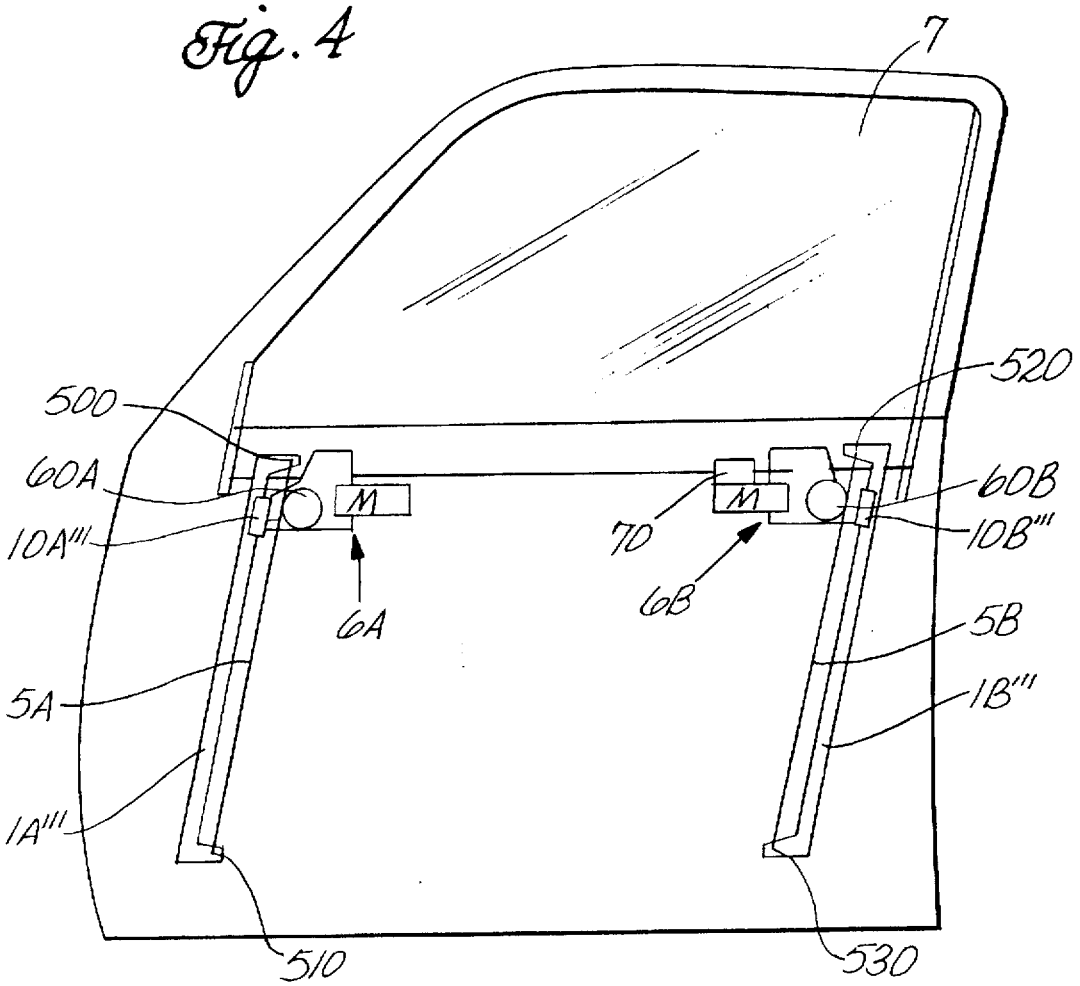
FIG. 4 is a schematic representation of a cable window regulator with two separate cables and respective separate motor drives.

An alternate embodiment, according to the schematic representation of FIG. 4, also accomplishes advantages of the invention wherein travel distances on two guide rails of a cable window regulator are not of the same size.

The regulating system consists of two drives 6A, 6B, which are attached to the window 7 and which bear carriers 10A"', 10B"', which are form-fittingly connected with the cross section of the guide rails 1A"', 1B"'. Separate cables 5A, 5B are stretched between the ends of the guide rails 1A"', 1B"' respectively by clamping points 500, 510, and 520, 530. They loop around the cable drums 60A, 60B, which can be made to rotate by each corresponding drive. Thus, drives 6A, 6B, connected with the window 7, cause the window to move upward or downward.

Since both drives 6A, 6B are controlled by a common electronic control unit 70, different travel distances or speeds of travel can be covered on the two guide rails 1A"', 1B"'. In conjunction with position detection which occurs within the electronic control unit, complex cable cycles are implemented.

The disclosure of attached German patent application, number P 44 27 989.2, filed on Aug. 8, 1994 is incorporated fully herein by reference. Priority of this German application is claimed.

Having now described the invention in detail as required by the patent statute, those skilled in the art will recognize modifications and substitutions to the embodiments disclosed herein. Such modifications and substitutions are encompassed within the present invention as defined in the following claims.

What is claimed is:

1. A two-strand cable window regulator comprising:

a spherically curved window, having a region of larger radius of curvature and a region of smaller radius of curvature spaced from said region of larger radius of curvature, for movement along a raising and lowering path;

two cable strands forming an endless cable loop:

a drive unit for transferring a driving force to said cable loop;

a plurality of cable guide blocks;

a first and a second window bracket attached to said window and guided along, respectively, first and second raising and lowering paths when the window moves along its raising and lowering path;

a first guide rail positioned nearer said region of smaller radius of curvature than said region of larger radius of curvature and a second guide rail positioned nearer said region of larger radius of curvature than said region of smaller radius of curvature, each of said first guide rail and said second guide rail having two ends, whose said two ends each bear one of said plurality of cable guide blocks over which said cable loop is guided, wherein the first guide rail is positioned nearer said region of smaller radius of curvature and the second guide rail is positioned nearer said region of larger radius of curvature; and a first carrier and a second carrier solidly connected to said cable loop, and respectively guided by said guide rail and said second guide rail along, respectively, first and second guide paths while moving said first and second window brackets along, respectively, said first and second raising and lowering paths, wherein the travel distance of said first carrier along said first guide path is the same as the travel distance of said second carrier along said second guide path, and wherein the travel distance of the first window bracket along its raising and lowering path is shorter than the travel distance of the second window bracket along its raising and lowering path.

2. The cable window regulation of claim 1, further comprising a compensating element acting at a right angle to the raising and lowering path of said window located between the first carrier and the first window bracket, wherein said first guide rail is slanted towards said second guide rail and said first carrier travel distance substantially corresponds to a second carrier travel distance defined by said second guide rail.

3. The cable window regulator of claim 2, wherein the second guide rail runs parallel to the raising and lowering path of said window.

4. The cable window regulator of claim 2, wherein the compensating element comprises a compensating rail which is connected to the first carrier and the first window bracket.

5. The cable window regulator of claim 4, wherein the first carrier is slidingly connected with said compensating rail.

6. The cable window regulator of claim 4, wherein the first window bracket is slidingly connected with said compensating rail.

7. The cable window regulator of claim 2, wherein said compensating element is at least a length of a short side of a parallelogram which is formed by a pair of parallel sides formed by top and bottom positions of the first carrier running parallel to the raising and lowering path and by a second pair of parallel sides formed by the first carrier at its top and bottom position perpendicular to the raising and lowering path.

8. The cable window regulator of claim 1, wherein at least one of said first guide rail and said second guide rail curves in a raising and lowering plane at a right angle to the raising and lowering path and defines an arc of curvature with an inside portion and an outside portion.

9. The cable window regulator of claim 8, wherein said at least one of said first guide rail and said second guide rail comprises said first guide rail wherein said first carrier connects to said first window bracket in the inside portion of the are of curvature.

10. The cable window regulator of claim 9, wherein said first carrier comprises a means for compensating for said arc of curvature of said first guide rail to compensate for a difference between carrier travel distance and window bracket travel distance at the first guide rail.

11. The cable window regulator of claim 10, wherein said means for compensating comprises a rotatable sliding element.

12. The cable window regulator of claim 10, wherein said means for compensating comprises a lengthwise elongated slot in which a bolt connected to said first window bracket engages said first carrier.

13. The cable window regulator of claim 1, wherein the raising and lowering path is within an object comprising an exterior side and interior side, and wherein the first guide rail having a first radius is disposed between the window and the exterior side, whereby said first radius of the first guide rail is larger than the smaller radius of curvature of the window, and the second guide rail having a second radius is disposed between the window and the interior side, whereby said second radius of the second guide rail is smaller than the larger radius of curvature of the window.

14. A cable window regulator comprising:

a spherically curved window, having a region of smaller radius of curvature and a region of larger radius of curvature, for movement along a raising and lowering path;

a first guide rail positioned nearer the region of smaller radius of curvature than the region of larger radius of curvature and a second guide rail positioned nearer the region of larger radius of curvature than the region of smaller radius of curvature;

a first carrier guided by the first guide rail and connected to a first window bracket attached to the window:

a second carrier guided by the second guide rail and connected to a second window bracket attached to the window, wherein a travel distance of said first carrier along said first guide rail is the same as a travel distance of said second carrier along said second guide rail;

at least one cable forming an endless cable loop coupled to the first and second carriers, movement of said first and second carriers by said cable causing movement of the first and second window brackets along respective raising and lowering paths; and means for differing a travel distance for said first window bracket along its raising and lowering path as compared to a traveled distance for said second window bracket along its raising and lowering path, while said brackets are attached to said window.

* * * * *

UNITED STATES PATENT AND TRADEMARK OFFICE

CERTIFICATE OF CORRECTION

PATENT NO. : 5,673,515

DATED : October 7, 1997

INVENTOR(S) : Horst Weber; Gerhard Hofmann

It is certified that error appears in the above-indentified patent and that said Letters Patent is hereby corrected as shown below:

Column 3, line 42, after "representation" and before "FIG. 3" insert -- of --.
Column 6, line 9, replace " R" " with -- $R_a$" --.
Column 7, line 30, after "said" and before "guide" insert -- first --.
Column 8, line 14, replace "are" with -- arc --.

Signed and Sealed this

Eleventh Day of August 1998

Bruce Lehman

*Attest:*

BRUCE LEHMAN

*Attesting Officer*

*Commissioner of Patents and Trademarks*